US006900400B2

(12) United States Patent
Rohlfing

(10) Patent No.: US 6,900,400 B2
(45) Date of Patent: May 31, 2005

(54) APPARATUS HAVING AN ENCLOSURE, AT LEAST ONE CIRCUIT BREAKER AND AT LEAST ONE PLUG RECEPTACLE

(75) Inventor: Ralph Rohlfing, Weyhe (DE)

(73) Assignee: aqua Signal Aktiengesellschaft Spezialleuchtenfabrik, Bremen (DE)

( * ) Notice: Subject to any disclaimer, the term of this patent is extended or adjusted under 35 U.S.C. 154(b) by 127 days.

(21) Appl. No.: 10/606,878

(22) Filed: Jun. 26, 2003

(65) Prior Publication Data

US 2004/0027768 A1 Feb. 12, 2004

(30) Foreign Application Priority Data

Jul. 3, 2002 (DE) ..... 202 10 357

(51) Int. Cl.[7] ..... H01H 9/20
(52) U.S. Cl. ..... 200/50.31
(58) Field of Search ..... 200/50.28–50.31

(56) References Cited

U.S. PATENT DOCUMENTS

| | | | | |
|---|---|---|---|---|
| 3,284,591 A | | 11/1966 | Daly | |
| 4,503,293 A | | 3/1985 | Knecht | |
| 5,298,701 A | * | 3/1994 | Sandor | 200/50.31 |
| 5,880,420 A | | 3/1999 | Johnson | |
| 5,998,744 A | | 12/1999 | Osborn | |
| 6,262,880 B1 | | 7/2001 | Fischer | |

FOREIGN PATENT DOCUMENTS

| | | |
|---|---|---|
| DE | 2658335 A1 | 7/1978 |
| DE | 9417178.5 U1 | 2/1995 |
| DE | 4332814 C2 | 8/1995 |
| DE | 10013938 C1 | 12/2001 |
| DE | 20201628 U1 | 8/2002 |
| EP | 0 067 129 A1 | 12/1982 |
| EP | 0 430 007 A2 | 6/1991 |
| EP | 0694433 A1 | 1/1996 |
| EP | 0902518 A2 | 3/1999 |

OTHER PUBLICATIONS

Europaischer Recherchebericht (German language copy of search results on related European application).
Recherchebericht (German language copy of search results onparent German application).

* cited by examiner

*Primary Examiner*—James R. Scott
(74) *Attorney, Agent, or Firm*—Technoprop Colton LLC

(57) ABSTRACT

An apparatus having an enclosure, at least one circuit breaker and at least one plug receptacle, in particular on ships to supply containers with electrical energy, the circuit breaker being arranged in the enclosure and the plug receptacle preferably being arranged on the outside of the enclosure. An interlocking of the circuit breaker and the plug receptacle is designed such that the circuit breaker can only be switched on when the plug receptacle is occupied and at the same time, it is only possible to remove a plug from the plug receptacle when the circuit breaker is switched off.

9 Claims, 19 Drawing Sheets

APPARATUS HAVING AN ENCLOSURE, AT LEAST ONE CIRCUIT BREAKER AND AT LEAST ONE PLUG RECEPTACLE

BACKGROUND OF THE INVENTION

1. Technical Field

The invention relates to an apparatus having an enclosure, at least one circuit breaker and at least one plug receptacle, in particular on ships to supply containers with electrical energy, the circuit breaker being arranged in the enclosure and the plug receptacle preferably being arranged on the outside of the enclosure.

2. Prior Art

Some of the containers transported on ships need to be supplied with electrical energy for cooling purposes or other reasons. Special sockets with circuit breakers in enclosures are provided in order to connect the containers to the electrical power supply system of the ship. The enclosures are predominantly fixed at their sides to upright walls on board the ship and accommodate at least one, but usually a plurality of plug receptacles (sockets) for connecting electrical cables connected to the containers. The connections, and correspondingly the plug receptacles, are largely standardized. The plug receptacles are usually provided on a side of the enclosure which points downwards. There are also safety regulations that prescribe that the circuit breaker should be prevented from being switched on in the event of an unoccupied plug receptacle and the plug should be prevented from being removed when the circuit breaker is switched on. In addition to electrical safety, mechanical safety is also highly important, and the harsher conditions at high sea should be taken into account.

The object of the present invention is to provide an enclosure of the type mentioned initially which meets the requirements with regard to electrical and mechanical safety as well as operational safety to a particularly high degree.

BRIEF SUMMARY OF THE INVENTION

A first concept of the invention relates to the interlocking of the circuit breaker and the plug receptacle. The interlocking is designed such that the circuit breaker can only be switched on when the plug receptacle is occupied. At the same time, it is only possible to remove a plug from the plug receptacle when the circuit breaker is switched off. For this purpose, the interlocking has the following features:

a) the circuit breaker can be actuated by a push element,
b) the push element is acted on by a lever arm of an actuating lever,
c) the actuating lever can be pivoted, about an actuating axis, at least between a switch-on position and a switch-off position,
d) the actuating lever has means for blocking the occupied plug receptacle in the switch-on position, and
e) the plug receptacle is assigned obstructing means, which block the movement of the push element when the plug receptacle is not occupied and can be deactivated by the plug receptacle becoming occupied.

The elements described permit a simple mechanical interlocking in accordance with the safety regulations for the operation of the described device on board ships.

The push element advantageously has guides, for the purpose of preventing movements that are transverse to the pushing direction, and is acted on by the lever arm, in a sliding manner. Particular measures for deflecting the movement of the lever arm are thus superfluous.

In one embodiment of the invention, the means for blocking the occupied plug receptacle is an obstructing lever which is connected to the actuating lever and, when the actuating lever moves, pivots into the switch-on position in front of the plug receptacle, namely into a movement area of a plug which can be removed from the plug receptacle. The obstructing lever thus prevents the plug from being removed when the circuit breaker is switched on.

The obstructing lever is preferably aligned approximately parallel to the actuating axis and extends approximately perpendicular to the lever arm or to an extension of the lever arm. The actuating axis in this case preferably runs perpendicular to the movement of the push element.

The obstructing means assigned to the plug receptacle comprise a blocking lever and a release pin, the said release pin being acted on when a plug is inserted into the plug receptacle and, in the process, moving the blocking lever from an obstructing position into a release position, the blocking lever, in the obstructing position, limiting the movement area of the push element, at least indirectly, such that the push element cannot be moved for the purpose of switching on the circuit breaker when the blocking lever is in the obstructing position. This represents a particularly simple mechanical interlocking of the circuit breaker when the plug receptacle is not occupied.

The blocking lever can be loaded by a spring in the direction of the obstructing position. The obstructing position is thus the starting position, which is only cancelled by a force counter to the action of the spring by the release pin.

The push element advantageously has a lateral projection that can be blocked by the blocking lever. The push element is provided with a push rod, for example, which has a short transverse rod as a projection. The blocking lever is preferably designed to have two arms, in the form of a flap which can be pivoted about a central axis, has, in the obstructing position, one side in the movement area of the projection or the transverse rod and thus blocks the movement of the push element. The other side of the flap can be acted on by the release pin. Preferably only one movement direction is blocked. This means that the push element is not blocked in the other movement direction and can push the blocking lever aside. It is thus possible to prevent the circuit breaker from being switched on when the plug receptacle is not occupied. A circuit breaker that has already been switched on, however, cannot be switched off when the plug receptacle is not occupied. The means required for this purpose are provided, as described by way of example.

According to a further concept of the invention, the enclosure is in the form of a deep-drawn part having at least one cover for covering an open side. An essentially rectangular enclosure has six sides. By producing the enclosure in the form of a deep-drawn part, only one side is open. All remaining sides are closed seamlessly. Seals and fixing means are only necessary in the region of the open side. Here, a cover may be used in a simple manner. This is preferably the side that is needed anyway for fitting components into the enclosure and/or is provided as the underside for the complete enclosure. By this means, it is not necessary to provide special protection against spray water from above and from the side on board ships.

The deep-drawn part is preferably produced from stainless steel. In particular, the cover is also produced from stainless steel. This provides particularly good weather- and climate-resistance as well as mechanical strength.

At least one plug receptacle is advantageously arranged on the cover. Associated with this are advantages in terms of the production and installation of the enclosure overall.

A further concept of the invention provides for the circuit breaker to be arranged on a push-in part, and for it to be possible to push this push-in part through an opening into the enclosure and, if appropriate, to withdraw it again. The push-in part with a circuit breaker and, if appropriate, other components, represents the contents of the enclosure and is manufactured and prepared for installation outside the enclosure, with the exception of the supply-end (ship-end) connections. These connections can be run through separate openings in the enclosure walls or in the cover and connected to a connection point for one or more circuit breakers.

The opening for pushing in and withdrawing the push-in part is preferably a side of the enclosure that was left open during construction. The opening can advantageously be closed by a cover that is connected to the push-in part. The plug receptacle is preferably also arranged on the cover.

In a refinement of the invention, the enclosure has fixing means for fixing it, such as to a wall or a support, with the opening pointing downwards. The enclosure and the push-in part can have guide means for pushing the push-in part into the enclosure in a guided manner. The electrical and mechanical components of the push-in part with a circuit breaker are thus protected against mechanical damage when the push-in part is pushed into the enclosure.

The enclosure and push-in part preferably have retaining means for retaining the push-in part on the enclosure in an at least partially withdrawn position. This considerably facilitates the initial installation as well as later maintenance work, in particular when the opening of the enclosure is pointing downwards and the push-in part is correspondingly pushed into the enclosure from below. Once the cover has been removed from the enclosure, the cover, along with the push-in part including the circuit breaker, can be withdrawn downwards from the enclosure and is secured against unintentionally falling out by the said retaining means. The guide means are advantageously designed and arranged such that the push-in part is guided in the direction of the retaining means when it is withdrawn and such that it is only possible to avoid the retaining means by additional measures.

Further features of the invention are described in the claims.

BRIEF DESCRIPTION OF THE DRAWINGS

Preferred exemplary embodiments of the invention are explained in more detail below with reference to drawings, in which.

DETAILED DESCRIPTION OF THE PREFERRED EMBODIMENTS

Figure 1:
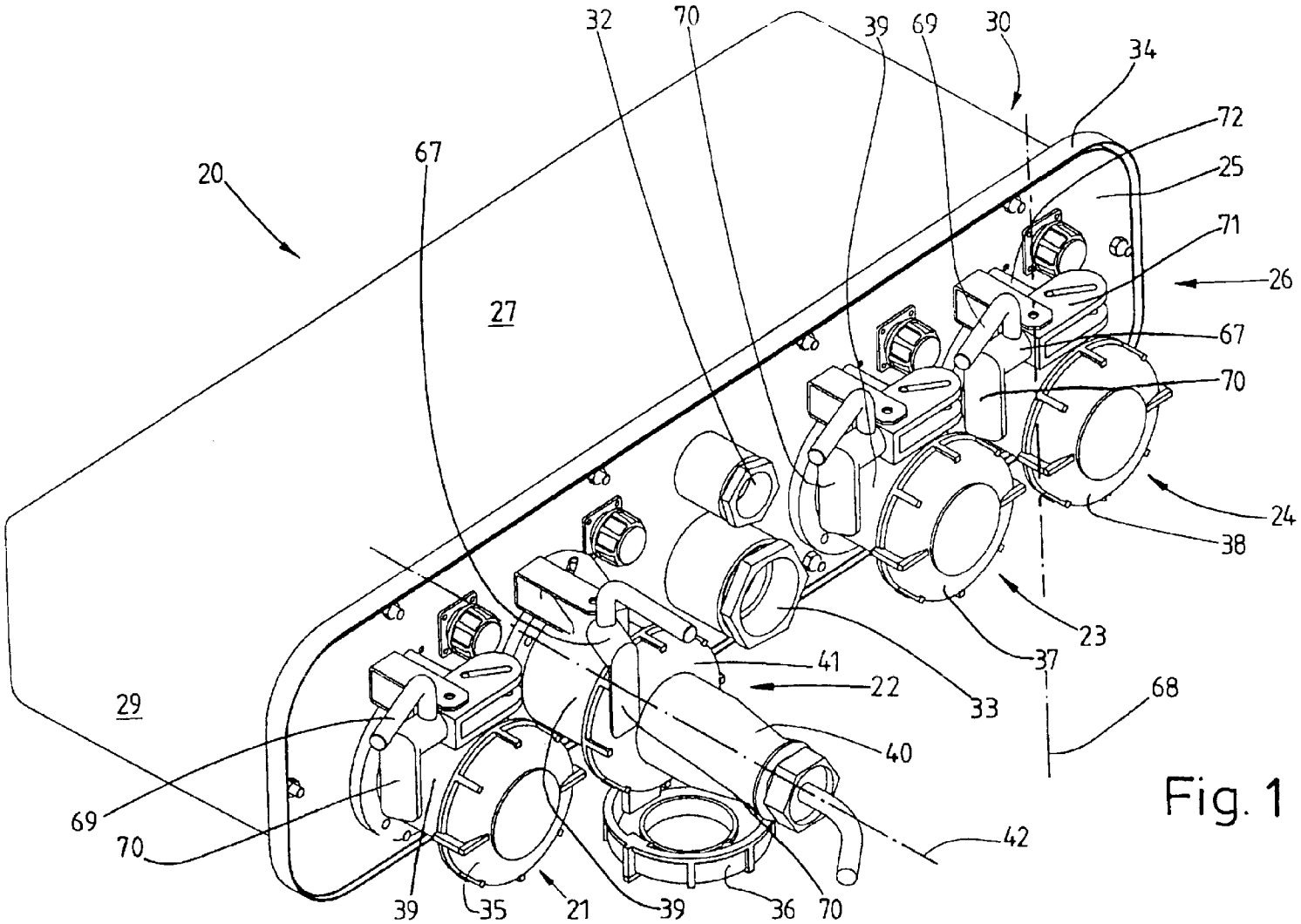
FIG. 1 shows a perspective view of a complete enclosure having an occupied plug receptacle.
Figure 2:
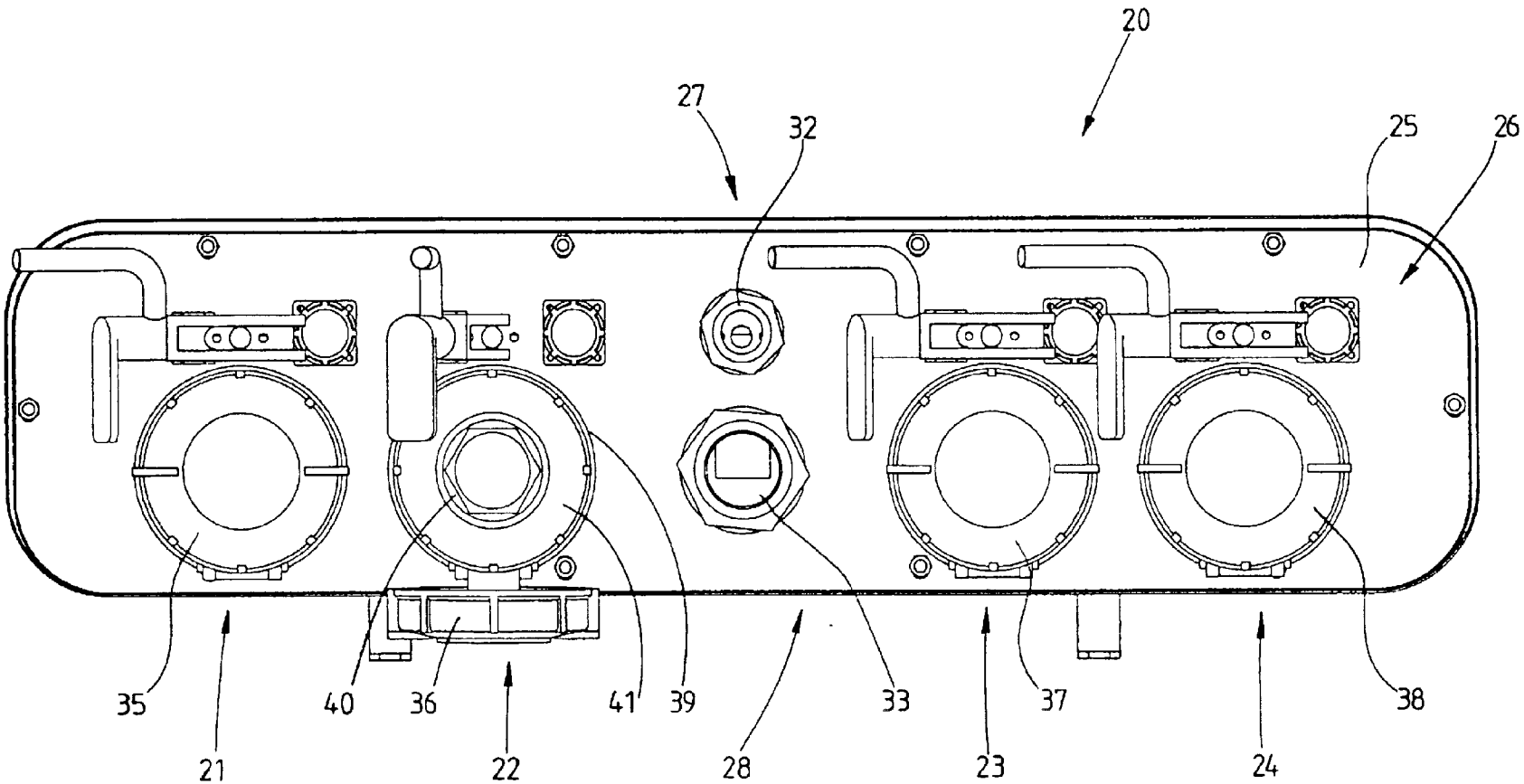
FIG. 2 shows the enclosure according to FIG. 1 in a plan view of a cover (underside).
Figure 3:
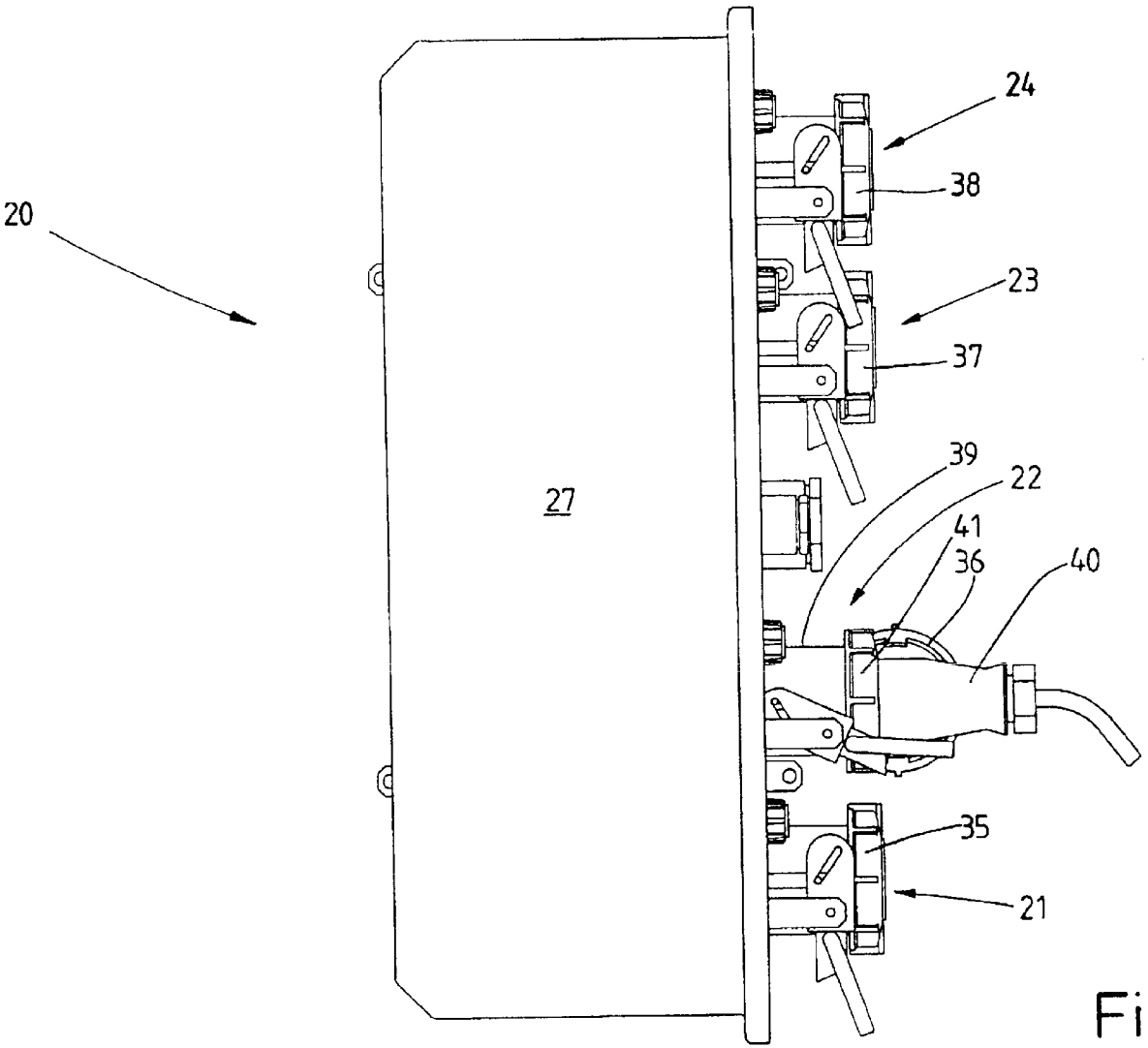
FIG. 3 shows the enclosure according to FIG. 1 in a plan view of a large side wall (outer side).
Figure 4:
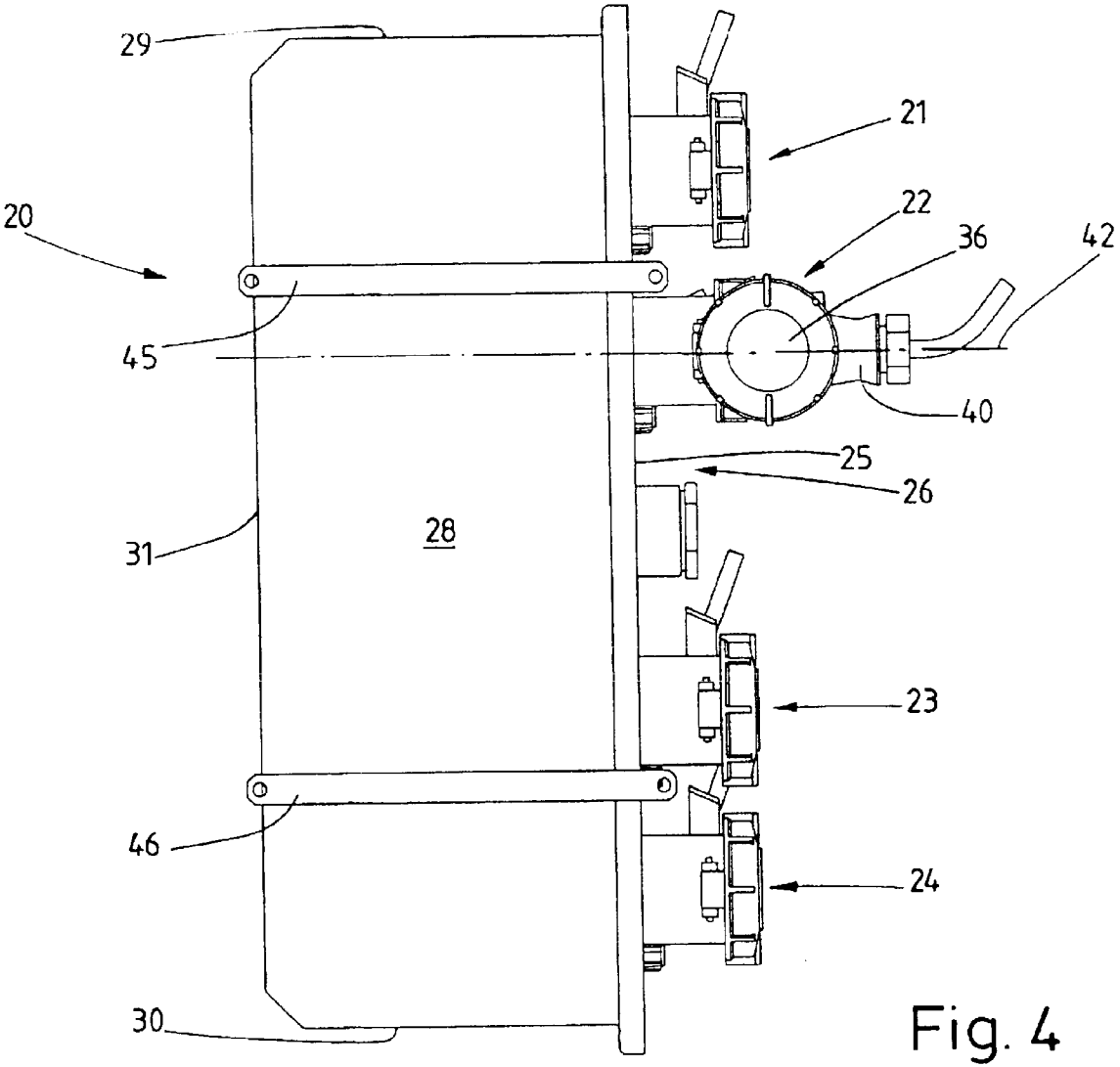
FIG. 4 shows the enclosure according to FIG. 1 in a plan view of the side opposite the outer side (installation side).

An enclosure 20 having four plug receptacles 21, 22, 23, 24 in the region of a cover 25 can be seen in FIGS. 1–9.The enclosure 20 is essentially cuboid. The cover 25 is, in the conventional arrangement of the enclosure 20 on an upright wall (not shown) on board a ship, at the same time a long narrow underside 26 of the enclosure 20. The underside is adjoined by a large-area wall, referred to as the outer wall 27, and a similarly large-area wall, referred to as the inner wall 28, since, in the conventional arrangement of the enclosure on an upright wall, it is hidden by the enclosure, see in particular FIG. 4. Furthermore, two smaller end sides 29, 30 adjoin the underside 26. Finally, the wall opposite the underside 26 is referred to as the upper side 31.

The plug receptacles 21–24 are arranged next to one another in a plane and also in pairs. This plane is referred to as the connecting plane and extends approximately parallel to the outer wall 27 or the inner wall 28. Between the in each case inner plug receptacles 22, 23 there is some space for connection openings 32, 33. Cables can be run through these connection openings 32, 33 in order to connect the enclosure 20 to an electrical power supply system. Alternatively, the cables, not shown, can be run through corresponding, in particular sealed holes in the enclosure 20.

The enclosure 20, which is deep-drawn from stainless steel, has, in the region of the underside 26, around its circumference, a projecting opening flange 34. The cover 25 is arranged exclusively within the opening flange 34 such that it is protected in this manner and is screwed to said opening flange 34 at a number of points, preferably eight, see FIG. 2. The cover 25 lies exclusively within an outer edge, projecting transversely to the plane of the cover, of the opening flange 34.

In the interior of the enclosure 20, each plug receptacle is assigned in each case one circuit breaker (not shown). Each of the circuit breakers has a toggle switch (not shown), which is actuated by a push element, described further below.

The plug receptacles 21–24 are in each case provided with a covering ring 35, 36, 37, 38. The covering ring 36 of the second plug receptacle 22 is, in FIGS. 1–6, unscrewed and flipped off into a plane parallel to the abovementioned connection plane. A plug 40 is inserted into a socket 39 of the plug receptacle 22 and secured on the plug receptacle 22 with a screw collar ring 41. The screw collar ring 41 has an analogous form to the covering ring 36 and can be stopped in the same way by being turned on the plug receptacle 22. The plug 40 and socket 39 have standardized contacts. The plug 40 defines, by means of its plugging direction, a plugging axis 42 parallel to the abovementioned connection plane and perpendicular to the plane of the underside 26 or the cover 25.

Figure 7:
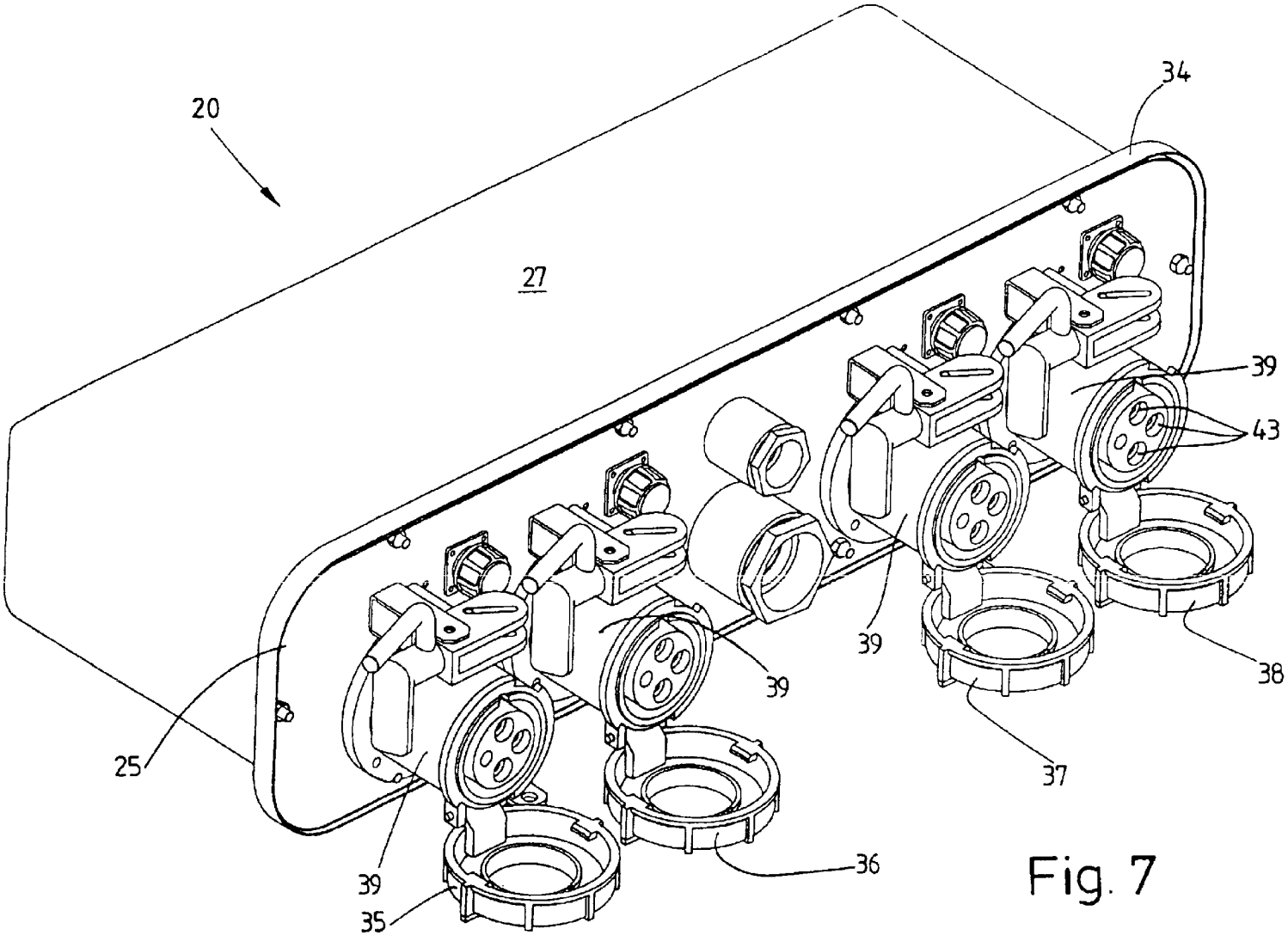
FIG. 7 shows a view corresponding to FIG. 1, but with none of the plug receptacles occupied.
Figure 8:
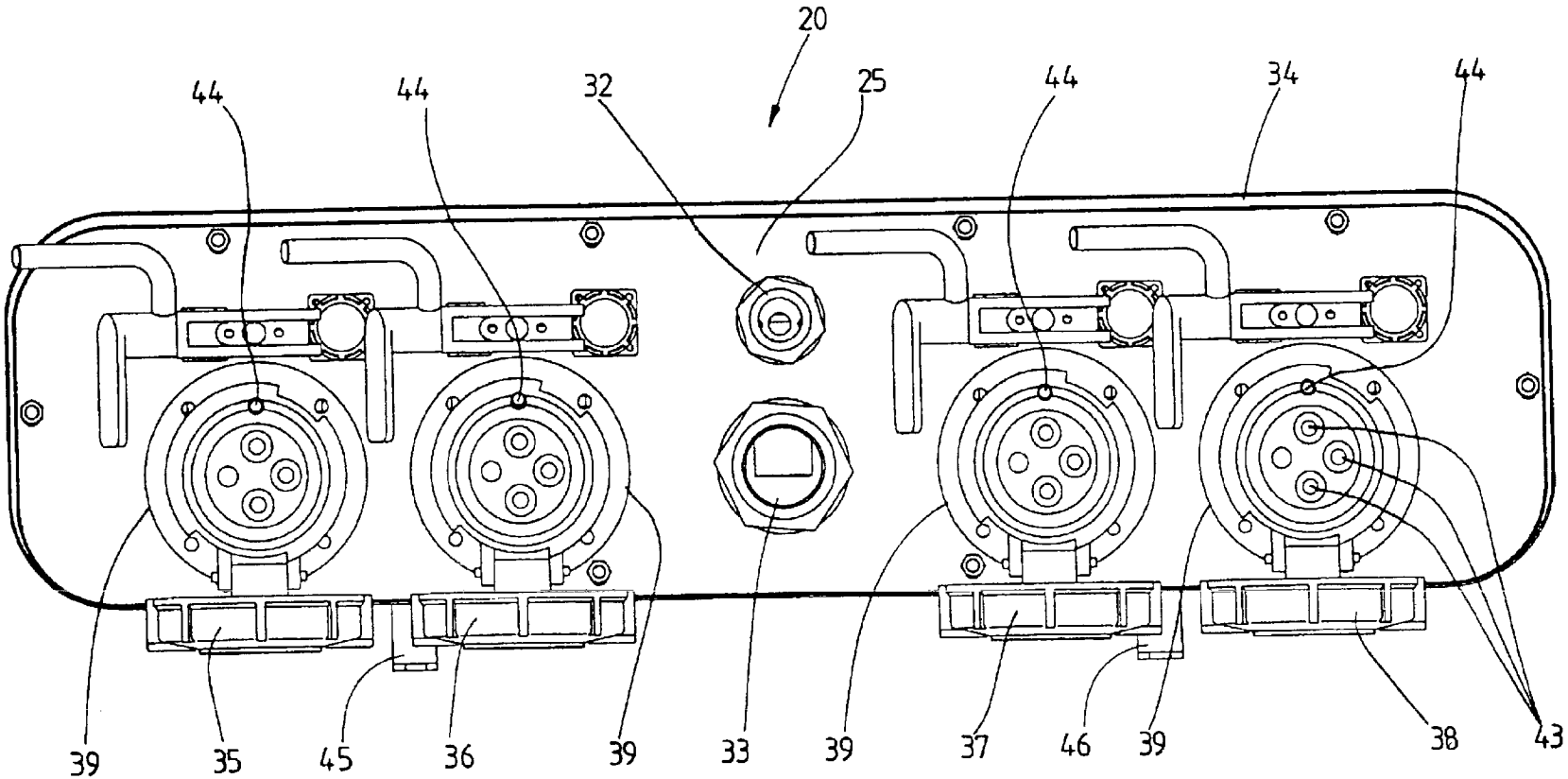
FIG. 8 shows a view corresponding to FIG. 2, but with none of the plug receptacles occupied.
Figure 9:
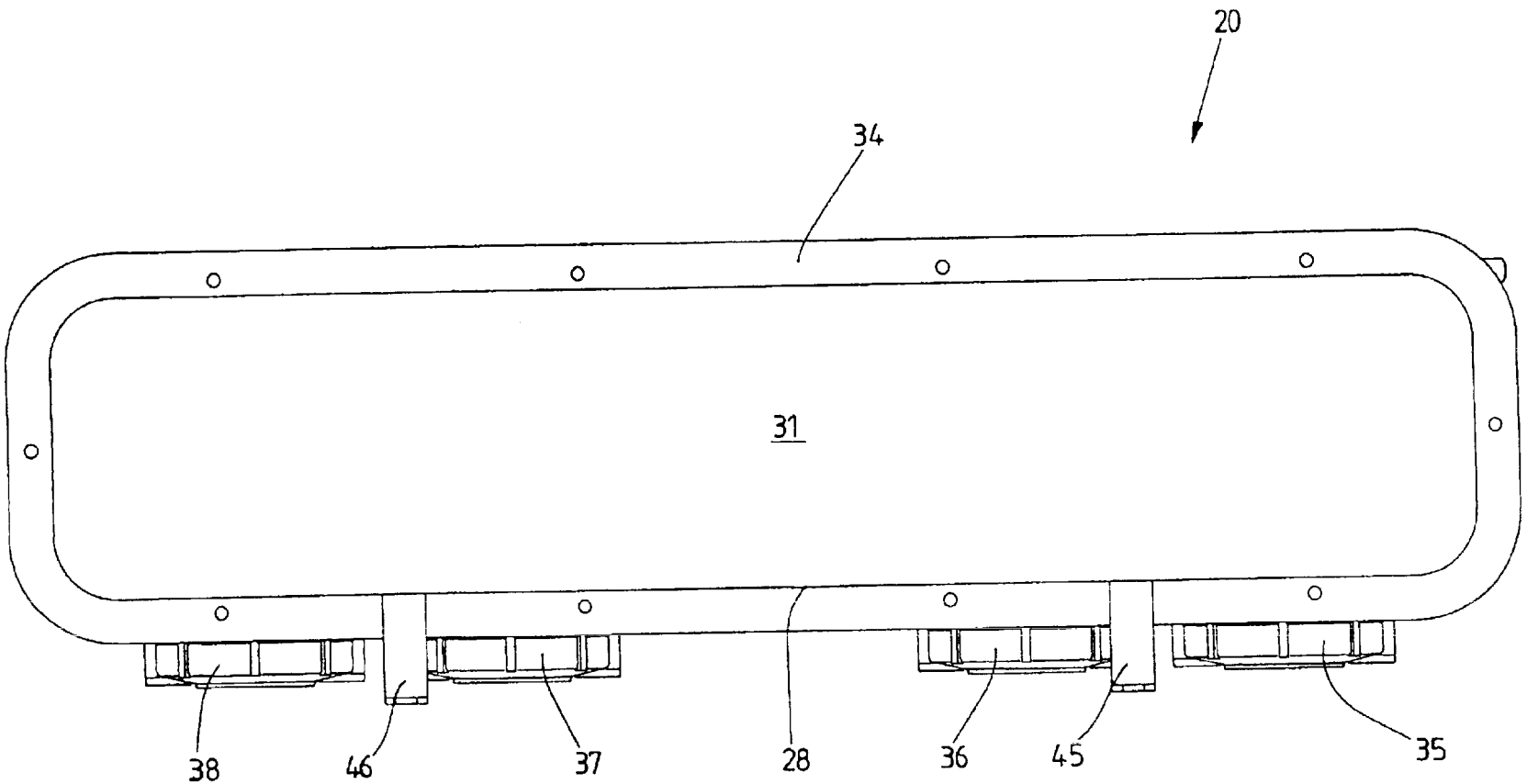
FIG. 9 shows a plan view of the enclosure on a side opposite the cover (upper side).

FIGS. 7–9 show the enclosure 20 without the plug inserted but with the covering rings 35–38 open. Electrical contacts 43 within each socket 39 are easily visible. Outside the electrical contacts 43, each socket 39 has a mechanical contact 44 that is described in more detail further below. In practice, the covering rings 35–38 are only opened in order to insert a plug into the respective plug receptacle 21 to 24.

Figure 5:
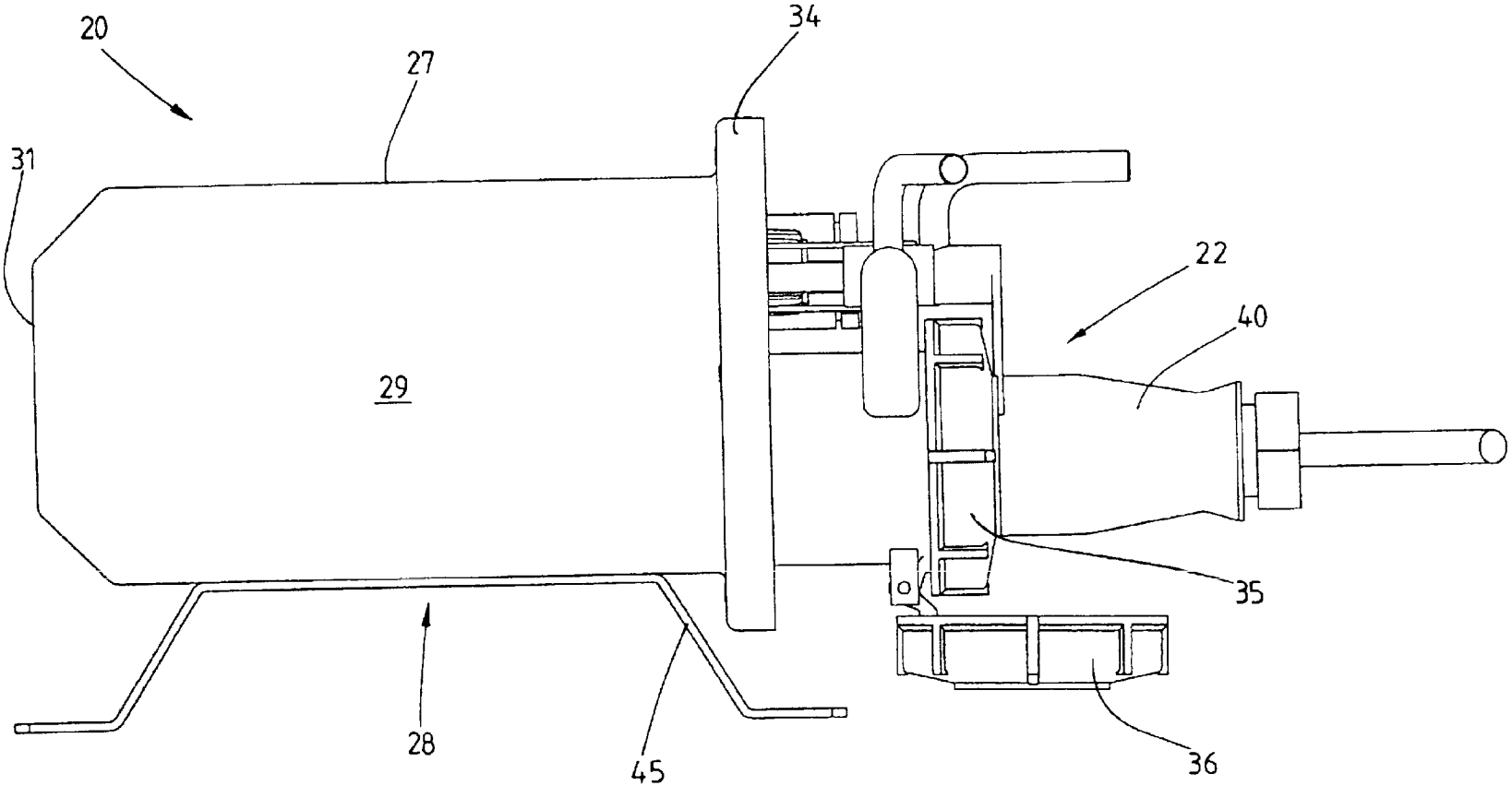
FIG. 5 shows the enclosure according to FIG. 1 in a plan view of an end side.
Figure 6:
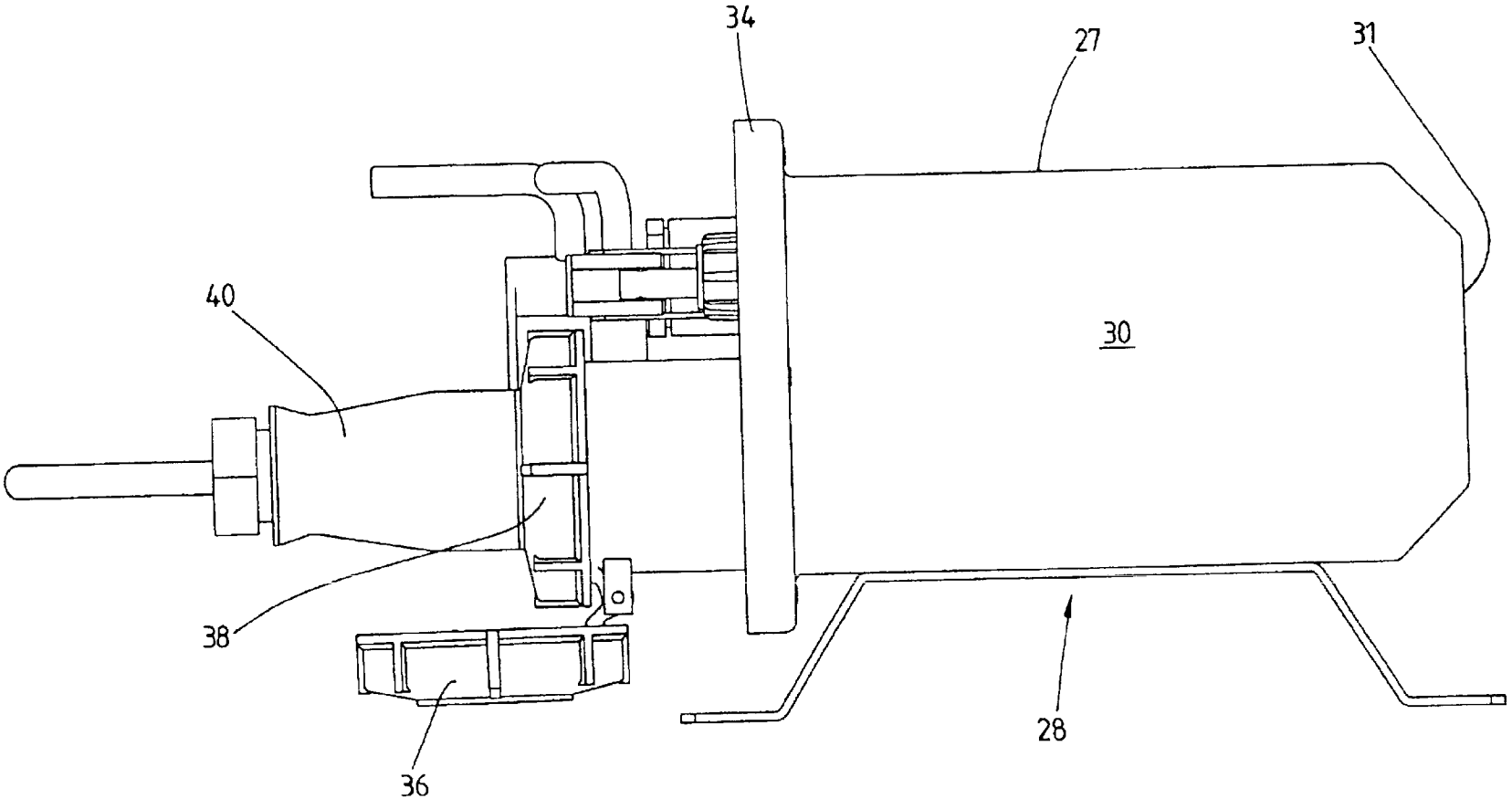
FIG. 6 shows the enclosure according to FIG. 1 in a plan view of a further end side.

In order to fix the enclosure 20 to an, in particular, upright wall (not shown), the enclosure 20 has, on its inner wall 28, corresponding fixing means, in this case two fixing brackets 45, 46 which are designed such that the inner wall 28 is held at a distance from the wall in order to ensure that there is sufficient clearance for the covering rings 35–38 opening in the direction of the wall, as shown in particular in FIGS. 5 and 6.

Figure 12:
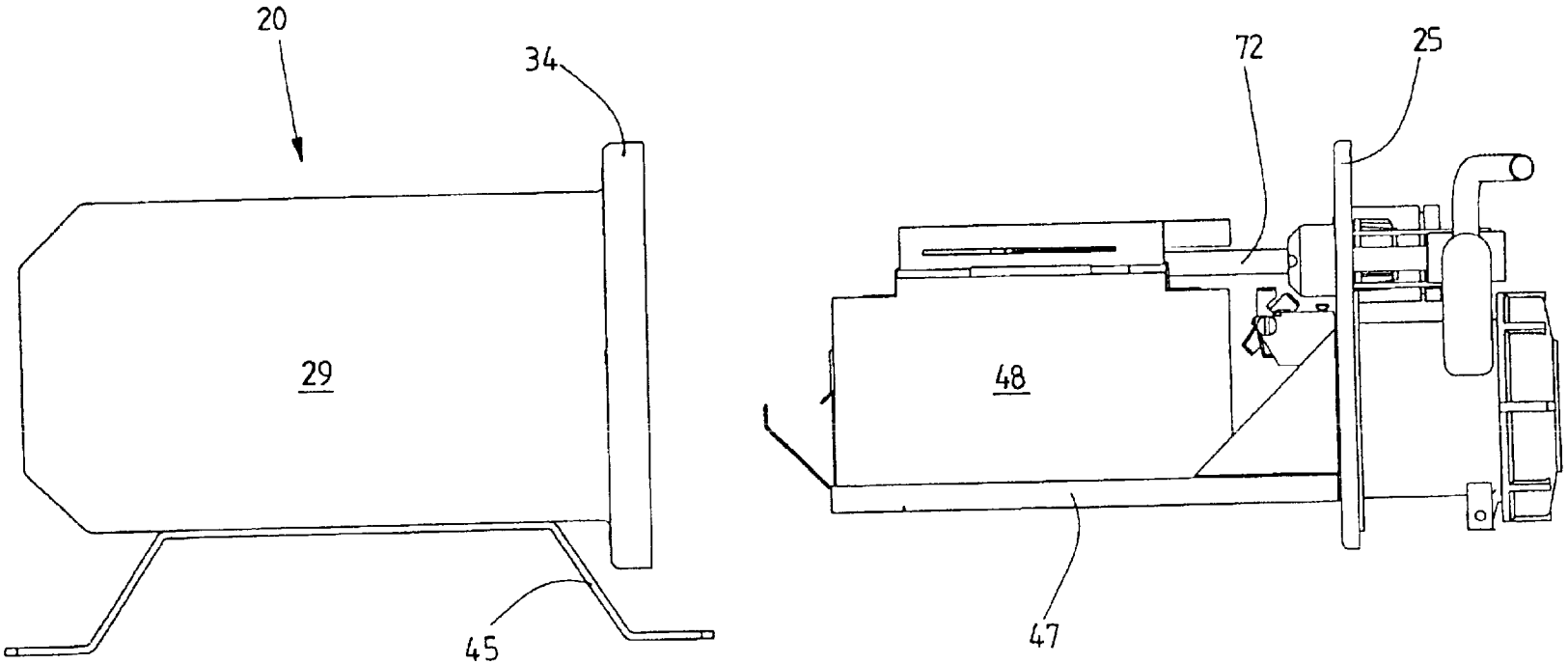
FIG. 12 shows a view of the end side of the enclosure with the push-in part and cover withdrawn.

A push-in part 47 is shown in FIG. 12 in front of the enclosure 20. Specifically, this push-in part 47 is a support, a chassis or the like which is fixedly connected to the cover 25 and, in this case, supports the four circuit breakers (not shown in detail) and other electrical and/or mechanical components. The plug receptacles 21 are inserted firmly in the covering rings 25. Electrical lines (not shown) run from the plug receptacles 21–24 to the circuit breakers 48.

Figure 13:
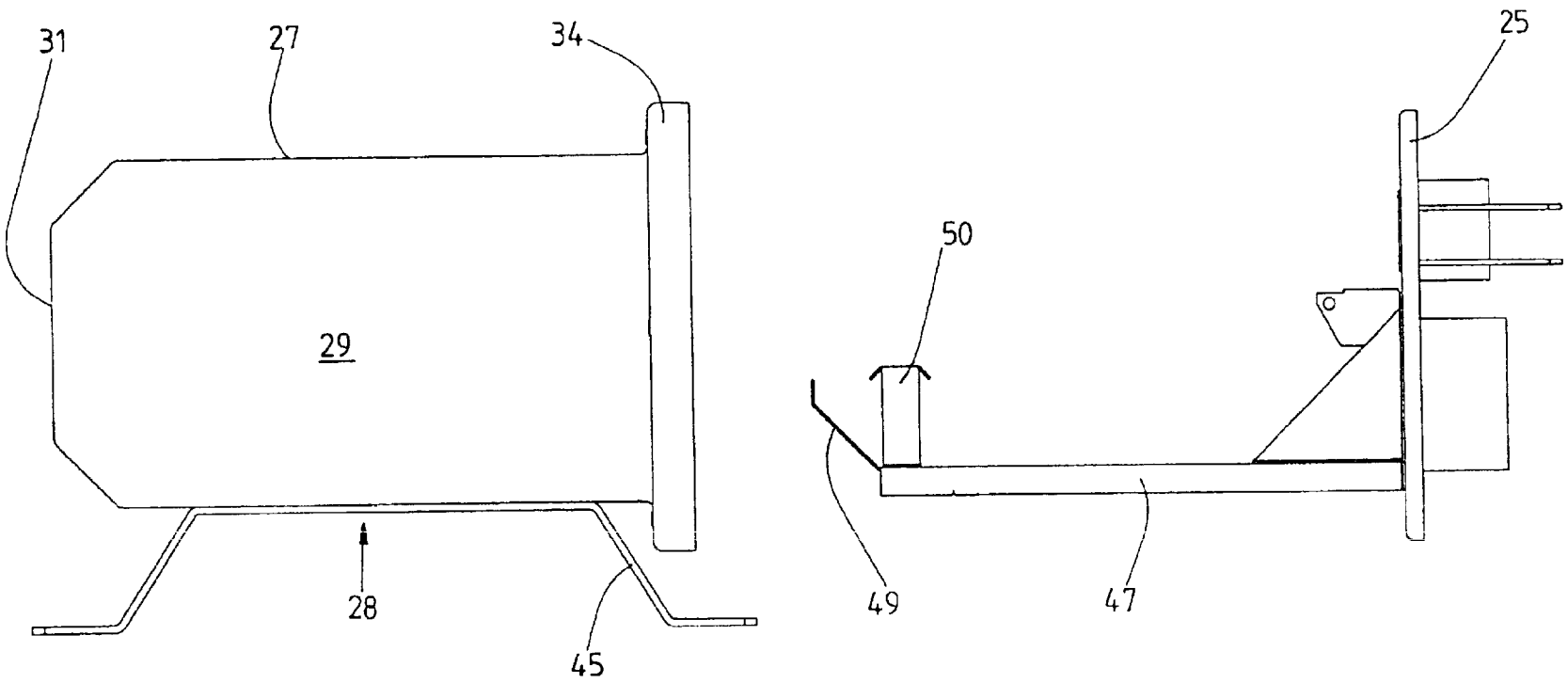
FIG. 13 shows a representation analogous to FIG. 12, but without electrical components and interlocking on the push-in part.

The push-in part 47 without the electrical and/or mechanical components can be seen in FIG. 13. Opposite the cover 25, the push-in part 47 has a retaining plate 49. Resting the retaining plate 49 on the upper side 31 (on the inside), which is opposite the cover 25, makes it possible to mount the push-in part 47 in the enclosure 20 in a play-free manner.

Figure 14:
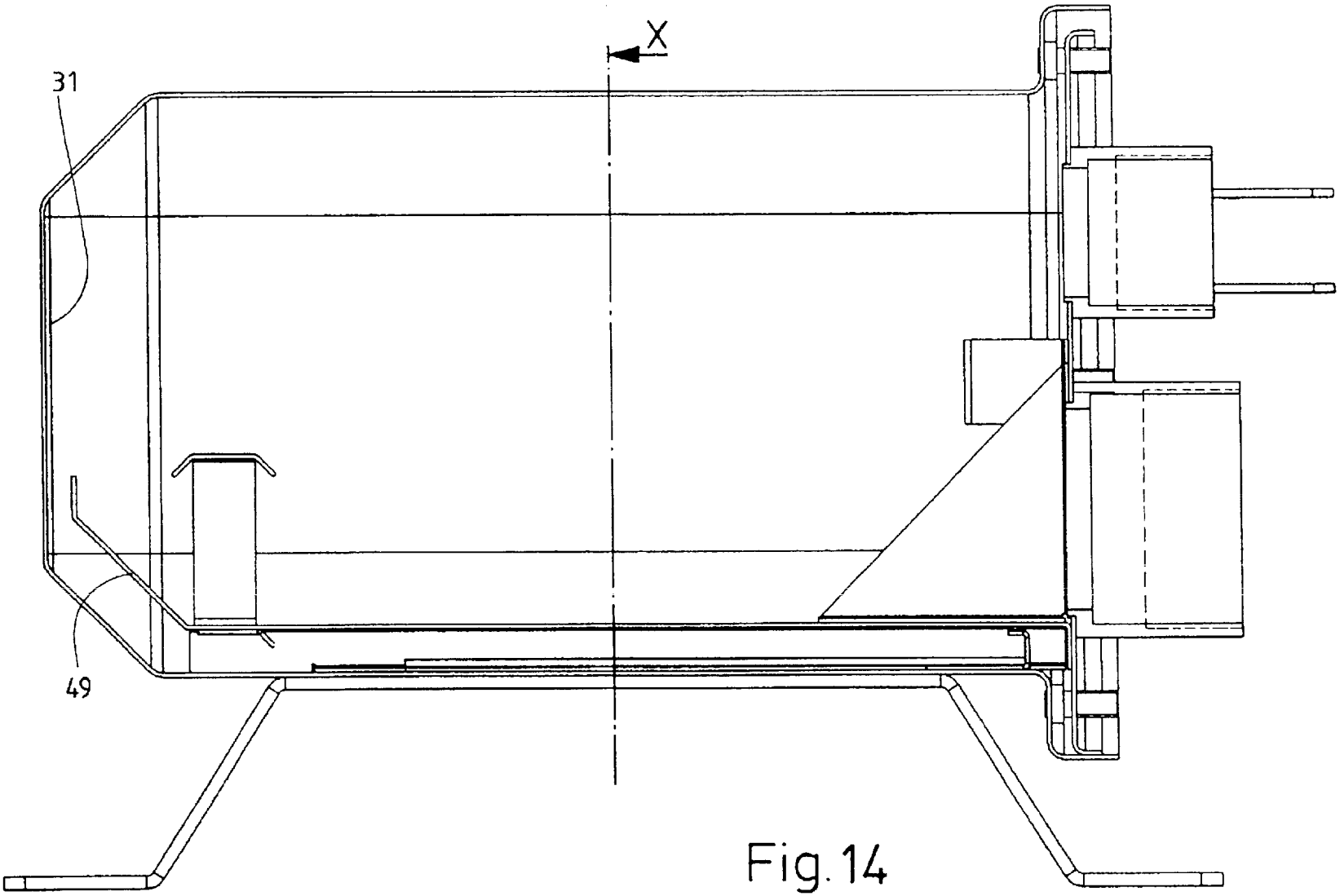
FIG. 14 shows a representation analogous to FIG. 13, but with the push-in part inserted in the enclosure.

A support 50 for components required, for example connection terminals or the like, is provided close to the retaining plate 49. The retaining plate 49 protects the components arranged on the push-in part 47, when the latter is pushed into the enclosure 20, and, for this purpose, extends over the entire width of the push-in part 47, as shown in particular in FIGS. 10 and 14. The retaining plate 49 extends from the push-in part 47 obliquely upwards in the direction of the upper side 31 and in the process covers approximately one third of the area or height of the upper side 31.

Figure 10:
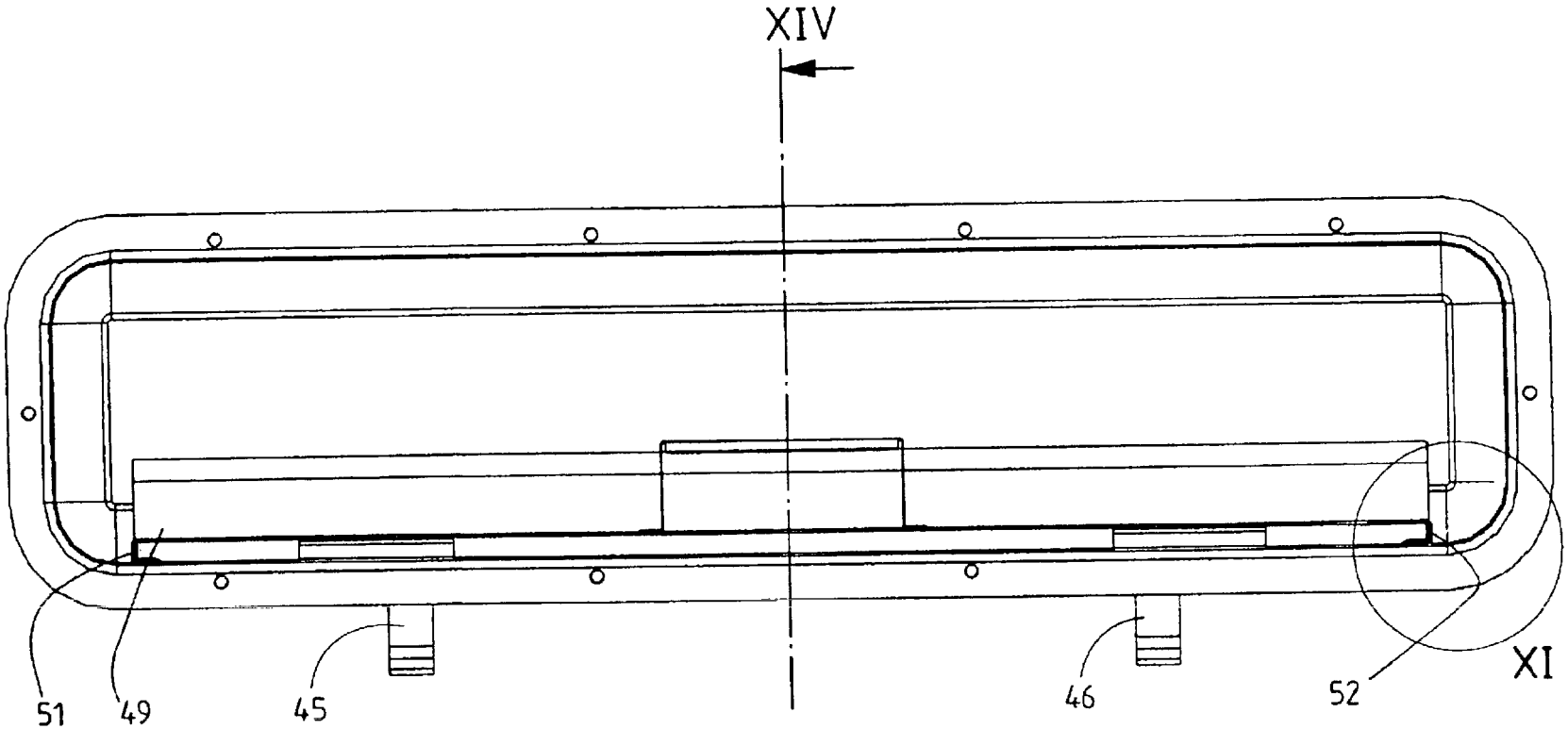
FIG. 10 shows a section through the enclosure along line X—X in FIG. 14, without the electrical components and interlocking means.
Figure 11:
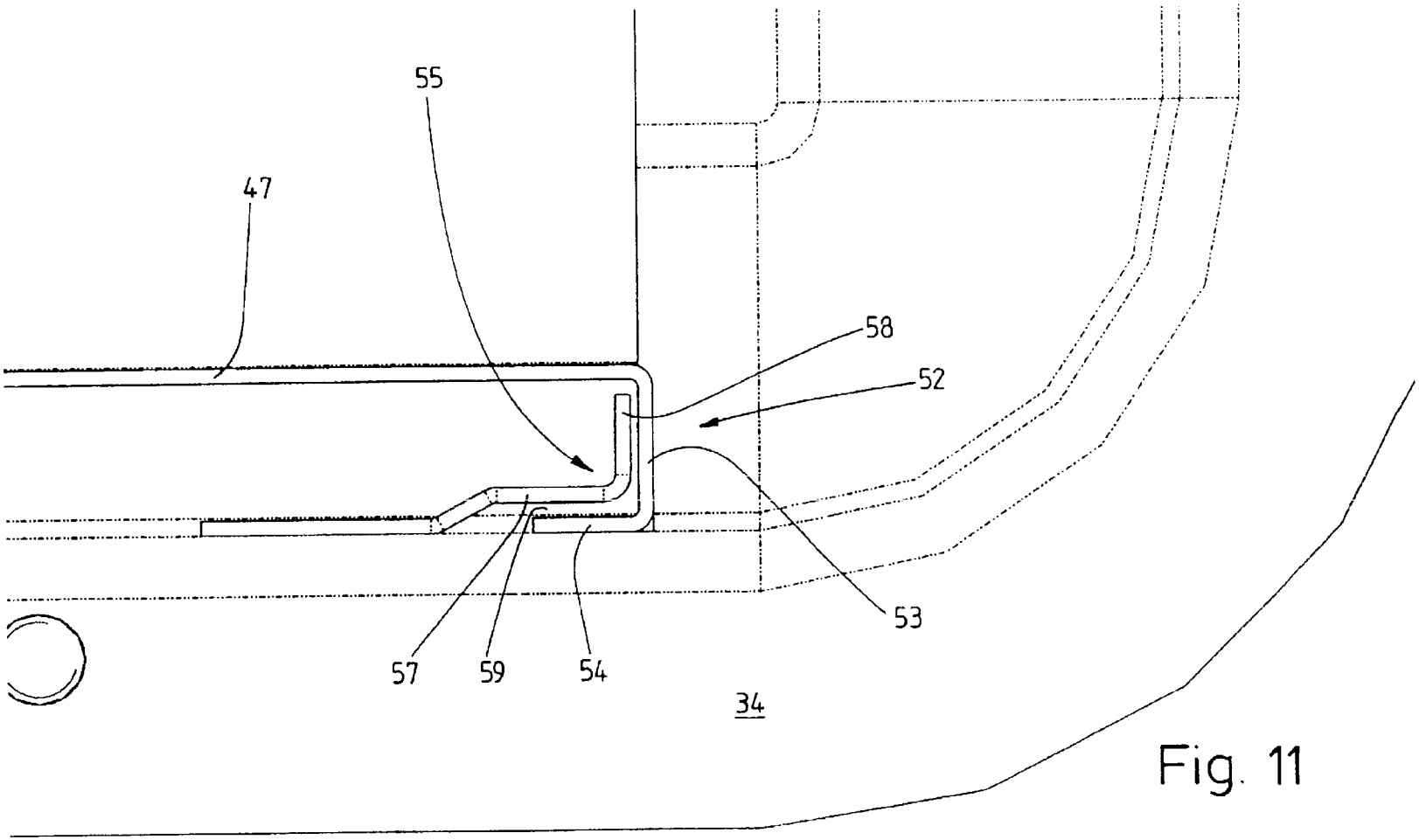
FIG. 11 shows an enlarged representation of a part region of FIG. 10, namely guide means between the push-in part and the enclosure.

A particular feature is the way in which the push-in part 47 is guided in the enclosure 20, as shown in particular in FIGS. 10 and 11. The push-in part has, for this purpose, edges 51, 52 with U-shaped ends, in each case having a limb 53, pointing downwards in FIG. 11, and an adjoining free limb 54 which is pointing inwards. Corresponding to this, the inner wall 28 has guide rails 55, 56 on the inside, in each case having a guide limb 57 which is pointing parallel to the free limb 54 and an adjoining free limb 58 running parallel to the limb 53. The free limb 54 of the edge 52 with U-shaped ends is guided between the guide limb 57 and the push-in part 47 when the latter is pushed into the enclosure 20. A corresponding interspace is designated by the numeral 59 in FIG. 11. The push-in part 47 can, owing to this guide, only be inserted into the enclosure 20 at a precisely defined distance from the inner wall 28. The free limb 58 also guides the push-in part 47 in a stable manner transversely to the push-in direction and parallel to the push-in part 47 or the inner wall 28.

Figure 15:
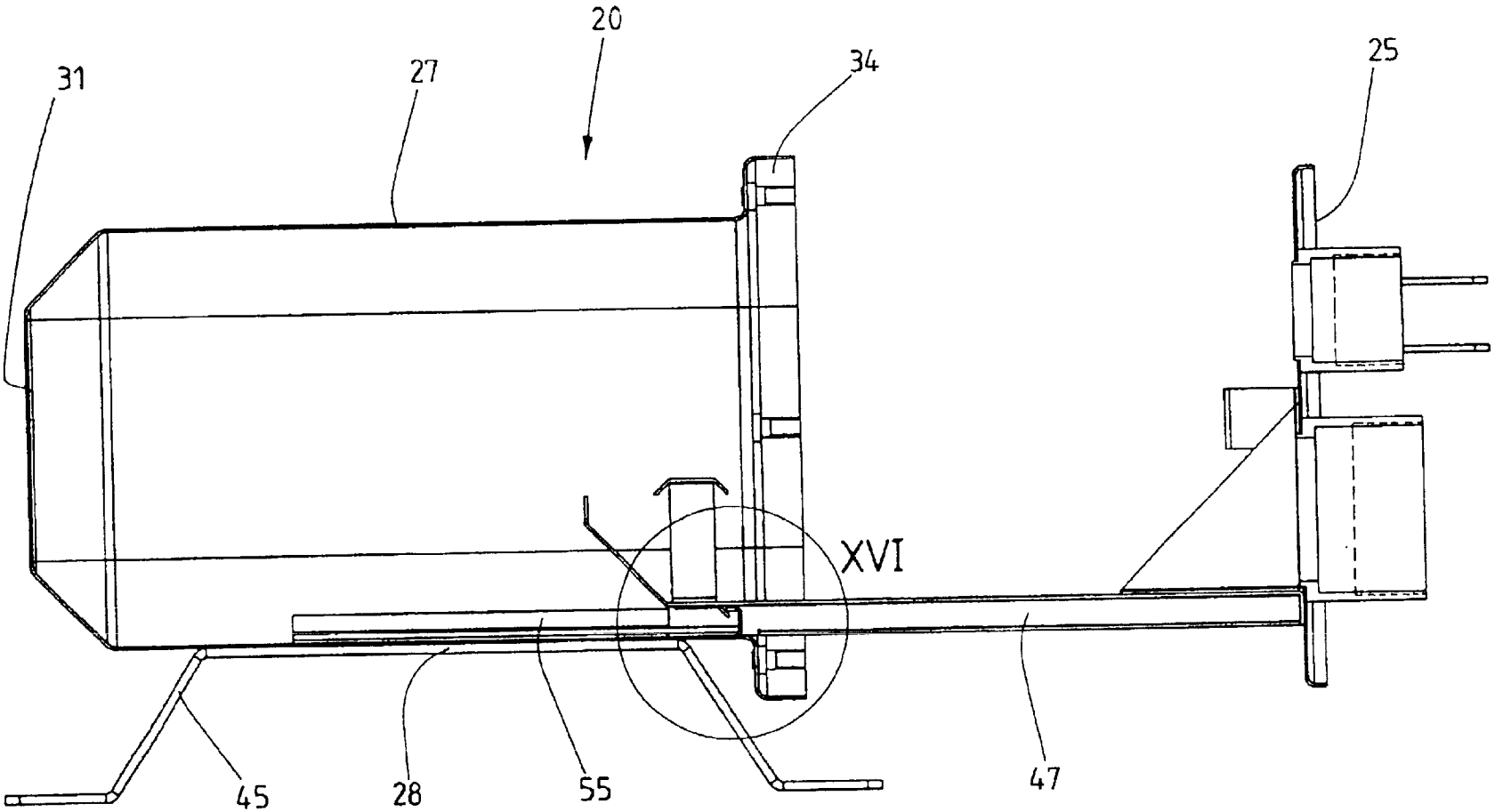
FIG. 15 shows a representation analogous to FIGS. 13 and 14 but with the push-in part partially withdrawn from the enclosure.
Figure 16:
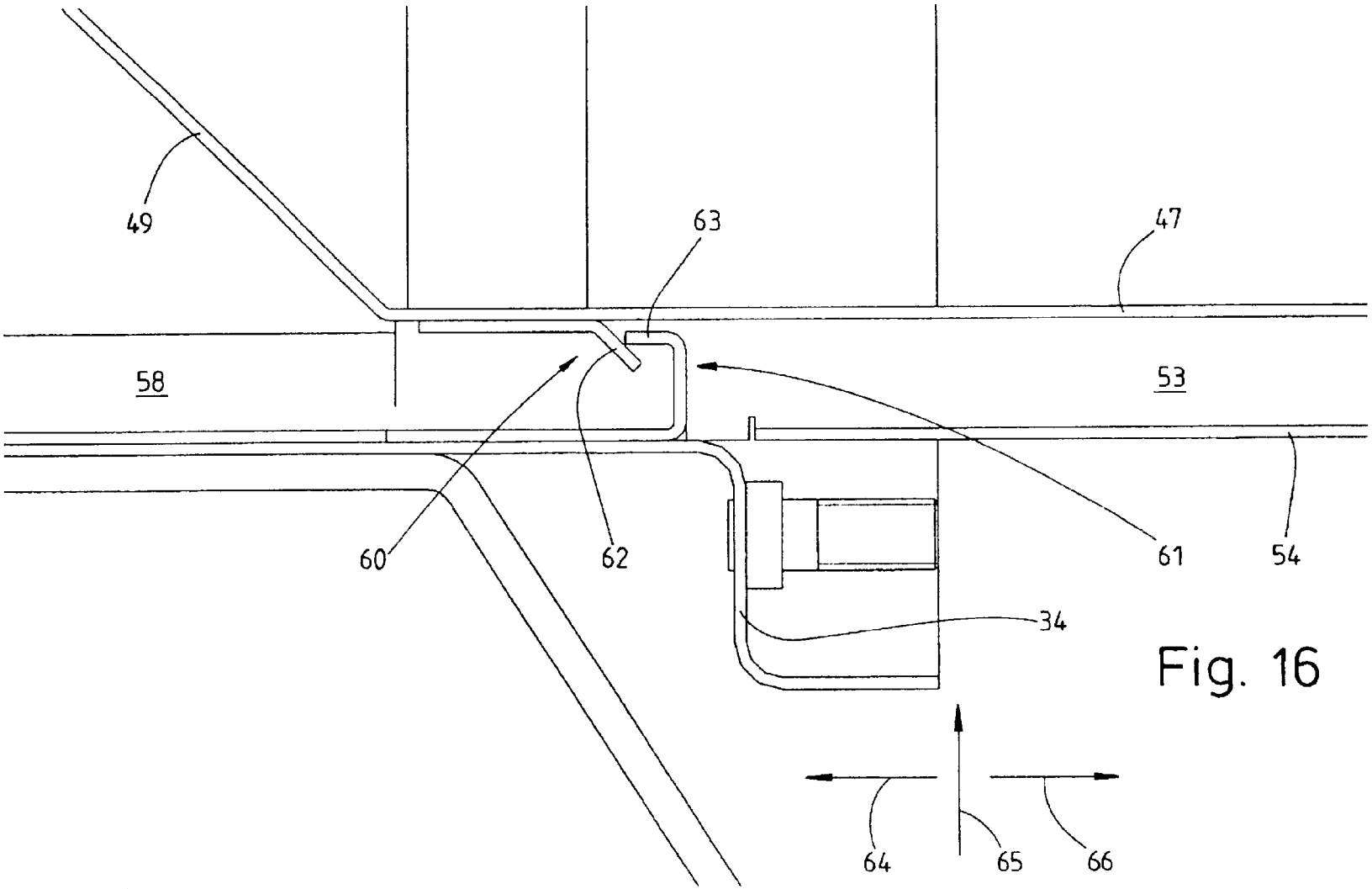
FIG. 16 shows an enlarged representation of a detail of FIG. 15, namely the retaining means between the enclosure and the push-in part.
Figure 17:
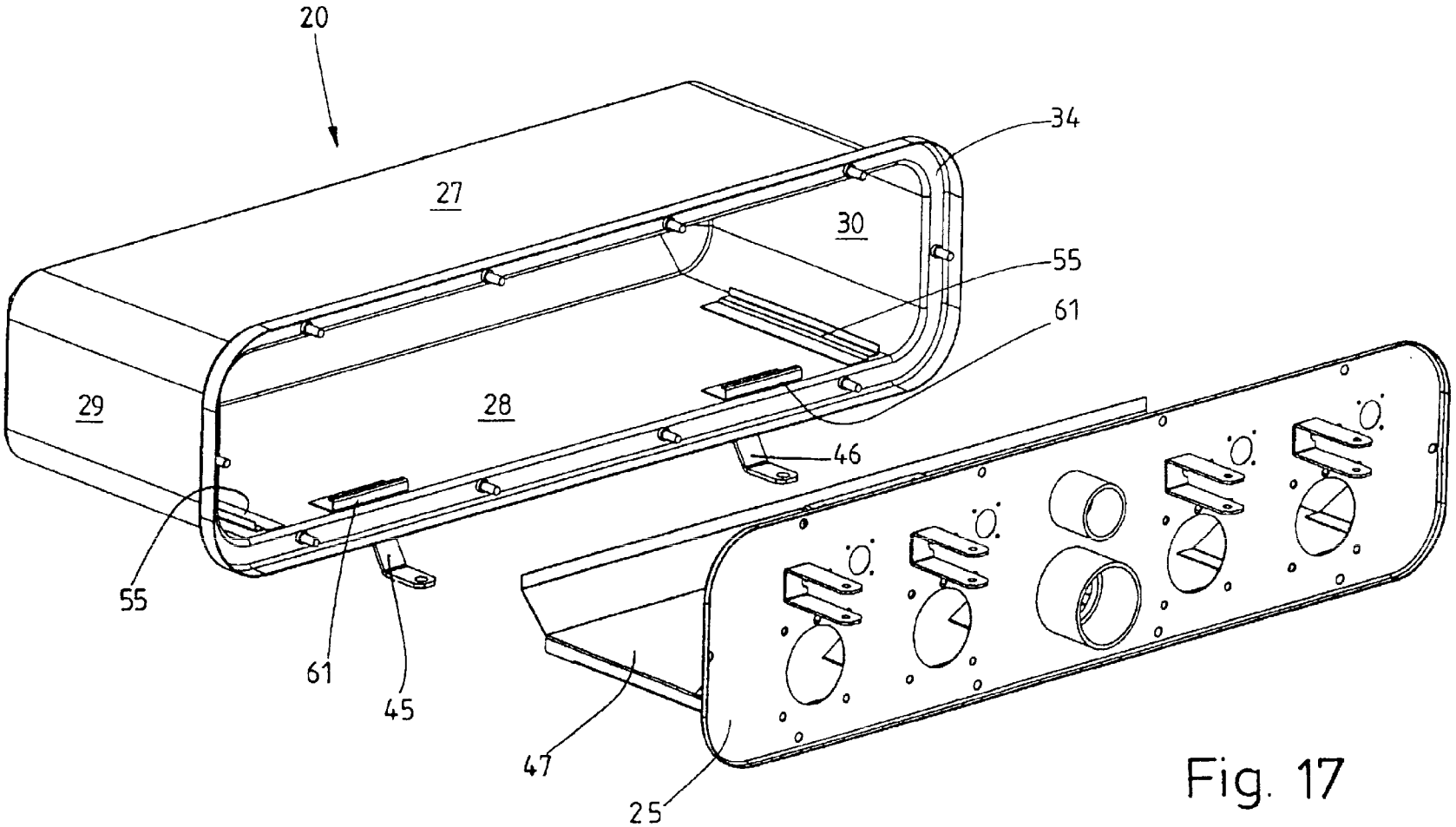
FIG. 17 shows a representation similar to FIG. 13, but in a perspective view.

The push-in part 47 is secured against being withdrawn from the enclosure 20 unintentionally. For this purpose, the push-in part 47 has a hook element 60 as a retaining means on its underside remote from the circuit breakers, as shown in particular in FIGS. 14, 15 and 16, and this hook element 60 is arranged close to the retaining plate 49, extends in the direction of the inner wall 28 and cooperates with a stopper element 61. The latter is arranged within the enclosure 20 on the inner wall 28, close to the opening flange 34. FIGS. 10 and 17 show two stopper elements 61. Correspondingly, the push-in part 47 has two hook elements 60.

A free limb 62 of the hook element 60 is angled at least slightly in the direction of a withdrawal direction of the push-in part 47 and hooks behind the free limb 63 of the stopper element 61 when it rests against the said stopper element 61. By this means the push-in part 47 is held, along with all the components connected to and mounted on it, securely on the enclosure 20, in particular in the conventional arrangement of the enclosure 20 with the cover 25 as the underside 26. It is only possible to lift the push-in part 47 out of the enclosure 20 by pushing the push-in part 47 slightly back into the enclosure 20, as shown by arrow 64 in FIG. 16, moving the push-in part slightly away from the inner wall 28, as shown by arrow 65, and subsequently withdrawing the push-in part 47 (withdrawal direction) from the enclosure 20, as shown by arrow 66 in FIG. 16.

The provision of the guide rail 55 or the configuration of the edges 51, 52 with U-shaped ends helps to secure the push-in part 47 against being unintentionally withdrawn. The guide rails 55 and edges 51, 52 are arranged such that it is only possible for the push-in part 47 to be released from the inner wall 28 just before the hook element 60 and the stopper element 61 come into contact. The movement along the guide rail 55 guides the hook element 60 directly into the stopper element 61. It is only possible to overcome the retaining means comprising the hook element 60 and the stopper element 61 by deliberately moving the push-in part 47 out of the movement direction, provided by the guidance of the guide rails 55, and only along a very short path which is provided. The short path mentioned is about 0.5–10 cm.

FIGS. 1–8 show interlockings in the region of the plug receptacles 21–24. Each plug receptacle is assigned a dedicated interlocking. Associated with each interlocking is an actuating lever 67, which can be pivoted to and fro about an actuating axis 68 between a switch-on position and a switch-off position. The actuating axis 68 extends perpendicular to the plugging axis 42 and, at the same time, perpendicular to the connection plane (not shown) mentioned initially. FIG. 1 shows the actuating lever 67 of the plug receptacles 21, 23, 24 in a switch-off position. Only the actuating lever 67 of the plug receptacle 22 is shown in the switch-on position. Close to the actuating axis 68, the actuating lever 67 has an L-shaped handle 69.

Connected to the actuating lever 67 is an obstructing lever 70 that is pivoted in the switch-on position in front of the screw collar ring 41 and prevents the plug 40 from being removed from the plug receptacle 22. The obstructing lever 70 is arranged at the end of the actuating lever 67, transversely to it, and extends approximately parallel to the actuating axis 68. In the switch-off position (plug receptacles 21, 23, 24 in FIG. 1), the obstructing lever 70 lies approximately to the side of and close to the associated socket 39.

The actuating lever 67 has, opposite the obstructing lever 70, a lever arm 71 (as an extension of the actuating lever 67) that acts on a push element 72 in a sliding and guided manner. The push element 72 is in the form of a push rod that extends essentially parallel to the plugging axis 42 and has means (not shown) for resting against the toggle switch of the respectively assigned circuit breaker. An axial movement of the push element 72 switches the circuit breaker on or off, depending on the movement direction.

The sliding guide between the lever arm 71 and the push element 72 is necessarily designed such that forces can be transmitted in both movement directions. Correspondingly, by the actuating lever 67 moving, the push element 72 can be moved for the purpose of switching the respectively associated circuit breaker in both axial directions.

Each plug receptacle 21–24 has obstructing means that block a movement of the push element 72 when the plug receptacle is not occupied and can be deactivated by the plug receptacle becoming occupied. In the present case, the mechanical contact 44 mentioned above in connection with FIG. 8 is of importance here. The contact 44 is a release pin that extends essentially parallel to the plugging axis 42 and can act on a blocking lever 73.

Figure 18:
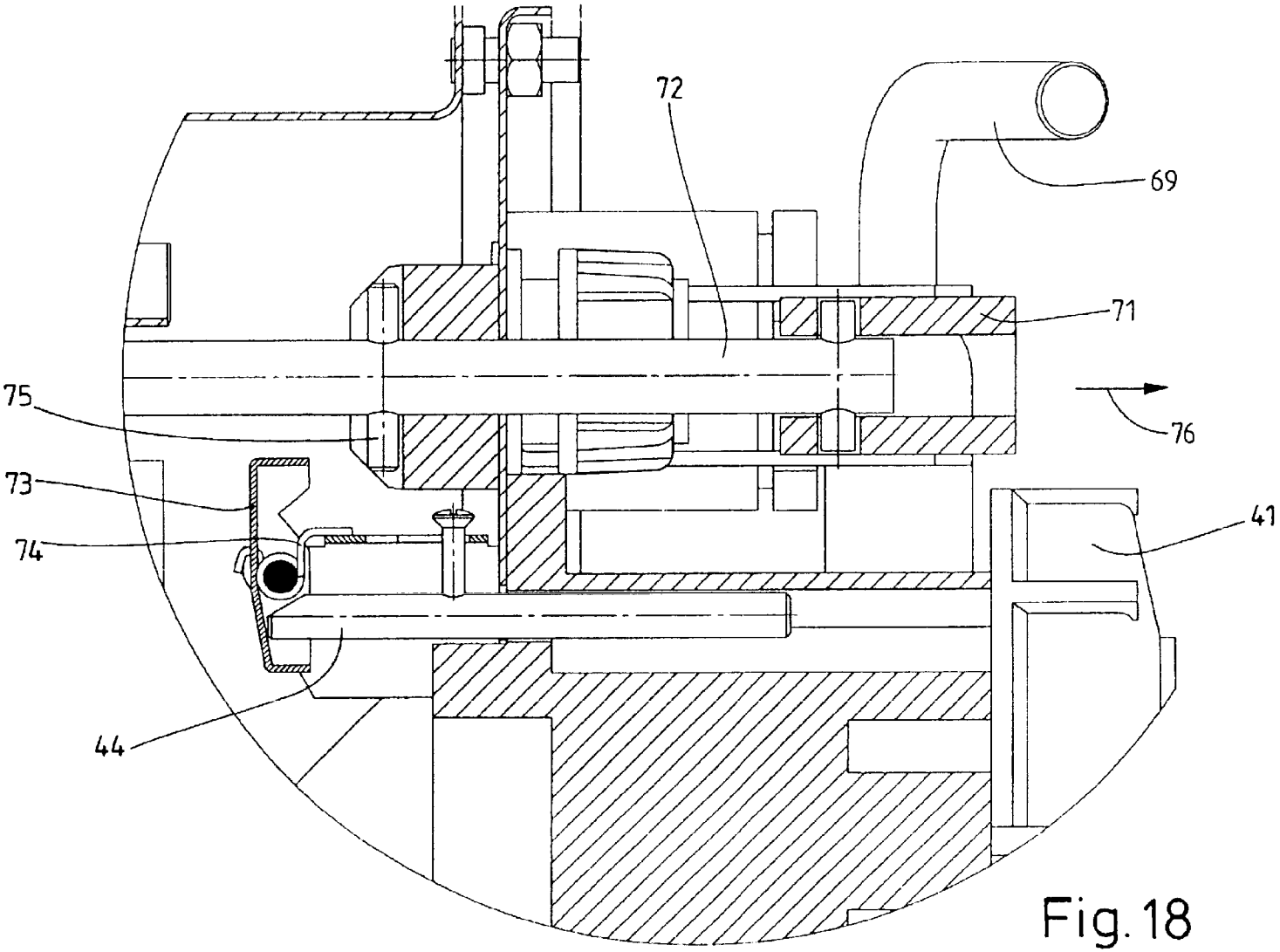
FIG. 18 shows a view similar to FIG. 5, but enlarged and in partial section, a representation of obstructing means in an obstructing position.
Figure 19:
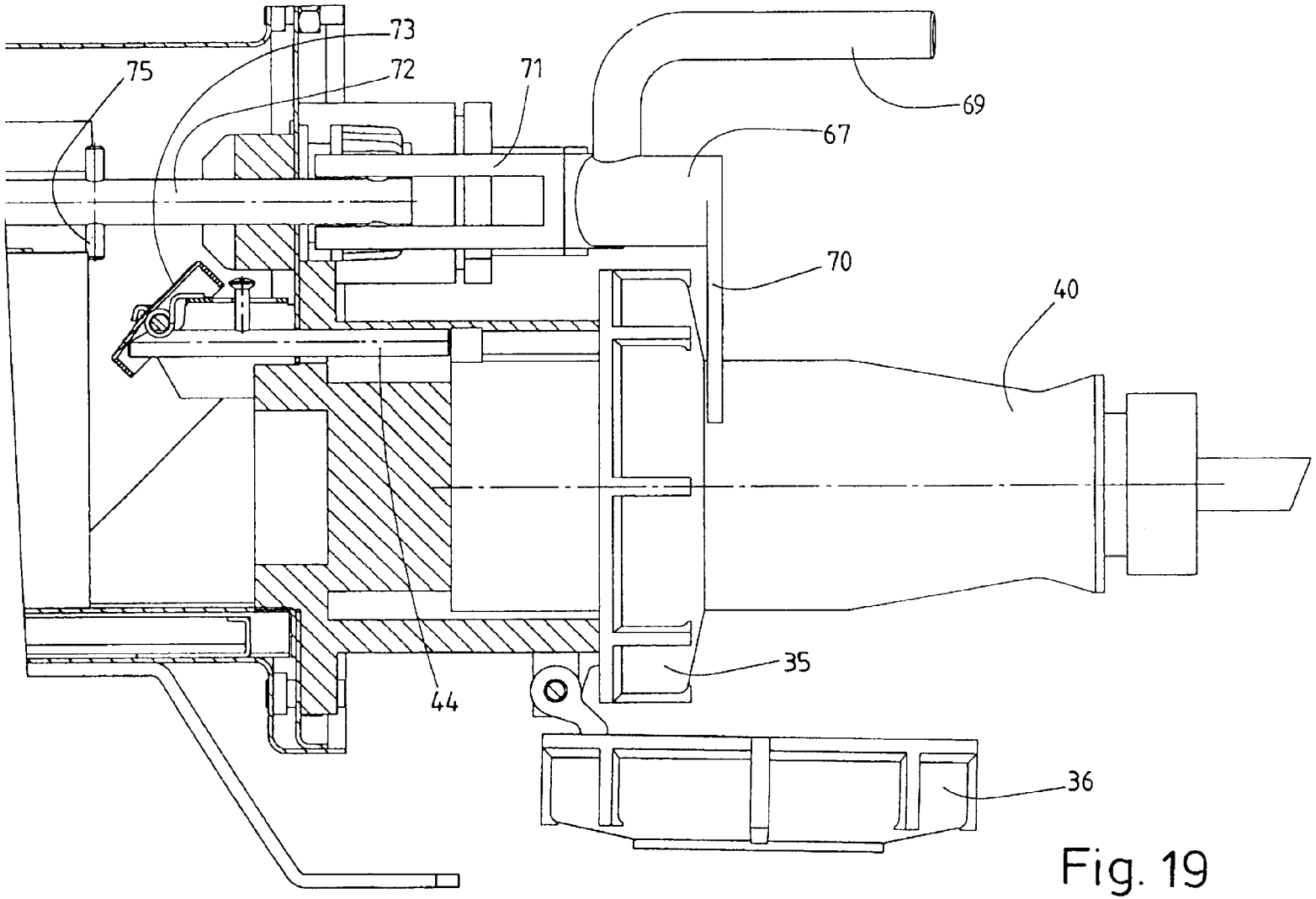
FIG. 19 shows a representation similar to FIG. 18, but in the release position.

When the plug 40 is inserted into the associated socket 39, the mechanical contact 44 or the release pin provided for this purpose is moved against the blocking lever 73 and pivots the latter from an obstructing position (FIG. 18) into a release position (FIG. 19). The blocking lever is acted on by a spring 74 counter to the pressure of the release pin (mechanical contact 44) such that, when the plug 40 is released, the blocking lever 73, with the release pin, returns automatically to its position according to FIG. 18 (obstructing position).

The blocking lever 73 lies in the obstructing position in the movement area of a short transverse rod 75 connected to the push element 72. Only when the blocking lever 73 has been pivoted by the release pin (mechanical contact 44) can the transverse rod 75 be moved past the blocking lever 73. The transverse rod 75 is thus a projection, lying in the movement area of the blocking lever 73, of the push element 72.

The blocking lever 73 pivots about an axis that runs perpendicular to the image plane of FIG. 18 or 19. The mechanical contact 44 is guided in a groove or hole such that only the described axial movement is possible.

The blocking lever 73 is a two-armed, pivotable flap that can in fact be forcibly moved out of the obstructing position by the mechanical contact 44. However, the blocking lever 73 can also be carried along by the transverse rod 75, but only by the push element 72 moving in the switch-off direction (arrow 76 in FIG. 18). In this case, only the counterpressure of the spring 74 need be overcome.

In place of the in each case four plug receptacles, circuit breakers and interlockings, more or fewer of these components may be provided. Units having 1, 2, 4 or 8 each of these components are preferred.

The above detailed description of the preferred embodiments and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

LIST OF REFERENCE NUMERALS

| | |
|---|---|
| 20 | Enclosure |
| 21 | Plug receptacle |
| 22 | Plug receptacle |
| 23 | Plug receptacle |
| 24 | Plug receptacle |
| 25 | Cover |
| 26 | Underside |
| 27 | Outer wall |
| 28 | Inner wall |
| 29 | End side |
| 30 | End side |
| 31 | Upper side |
| 32 | Connection opening |
| 33 | Connection opening |
| 34 | Opening flange |
| 35 | Covering ring |
| 36 | Covering ring |
| 37 | Covering ring |
| 38 | Covering ring |
| 39 | Socket |
| 40 | Plug |
| 41 | Screw collar ring |
| 42 | Plugging axis |
| 43 | Electrical contacts |
| 44 | Mechanical contacts |
| 45 | Fixing bracket |
| 46 | Fixing bracket |
| 47 | Push-in part |
| 48 | Circuit breaker |
| 49 | Retaining plate |
| 50 | Support |
| 51 | Edges with U-shaped ends |
| 52 | Edges with U-shaped ends |
| 53 | Limb |
| 54 | Free limb |
| 55 | Guide rail |
| 56 | Guide rail |
| 57 | Guide limb |
| 58 | Free limb |
| 59 | Interspace |
| 60 | Hook element |
| 61 | Stopper element |
| 62 | Free limb |
| 63 | Free limb |
| 64 | Arrow |
| 65 | Arrow |
| 66 | Arrow |
| 67 | Actuating lever |
| 68 | Actuating axis |
| 69 | Handle |
| 70 | Obstructing lever |
| 71 | Lever arm |
| 72 | Push element |
| 73 | Blocking lever |
| 74 | Spring |
| 75 | Transverse rod |
| 76 | Arrow |

What is claimed is:

1. An apparatus comprising an enclosure (20), at least one circuit breaker (48) and at least one plug receptacle (21–24) to supply containers with electrical energy, the circuit breaker (48) being arranged in the enclosure (20) and the plug receptacle (21–24) being arranged on the outside of the enclosure (20), with an interlocking of the circuit breaker (48) and the plug receptacle (21–24) being provided such that the circuit breaker (48) can only be switched on when the plug receptacle (21–24) is occupied and a plug (40) can only be removed from the associated plug receptacle (21–24) when the circuit breaker (48) is switched off, wherein the interlocking comprises the following features:

a) the circuit breaker (48) can be actuated by a push element (72), b) the push element (72) is acted on by a lever arm (71) of an actuating lever (67), c) the actuating lever (67) can be pivoted, about an actuating axis (68), at least between a switch-on position and a switch-off position, d) the actuating lever (67) has means for blocking the occupied plug receptacle (21–24) in the switch-on position, and e) the plug receptacle (67) is assigned obstructing means that block the movement of the push element (72) when the plug receptacle (21–24) is not occupied and can be deactivated by the plug receptacle (21–24) becoming occupied.

2. The apparatus according to claim 1, characterized in that the push element (72) has guides and is acted on by the lever arm (71), in a sliding manner.

3. The apparatus according to claim 1, characterized in that the means for blocking the occupied plug receptacle (21–24) is an obstructing lever (70) which is connected to the actuating lever (67) and, when the actuating lever (67) moves, pivots into the switch-on position in front of the plug receptacle (21–24), namely into a movement area of a plug (40) that can be removed from the plug receptacle (21–24).

4. Apparatus according to claim 3, characterized in that the obstructing lever (70) is aligned approximately parallel to the actuating axis (68) and extends approximately perpendicular to the lever arm (71) or to an extension of the lever arm (71).

5. The apparatus according to claim 2, characterized in that the means for blocking the occupied plug receptacle (21–24) is an obstructing lever (70) which is connected to the actuating lever (67) and, when the actuating lever (67) moves, pivots into the switch-on position in front of the plug receptacle (21–24), namely into a movement area of a plug (40) that can be removed from the plug receptacle (21–24).

6. Apparatus according to claim 5, characterized in that the obstructing lever (70) is aligned approximately parallel to the actuating axis (68) and extends approximately perpendicular to the lever arm (71) or to an extension of the lever arm (71).

7. Apparatus according to claim 1, characterized in that the obstructing means comprise a blocking lever (73) and a release pin, the said release pin being acted on when a plug (40) is inserted into the plug receptacle (21–24) and, in the process, moving the blocking lever (73) from an obstructing position into a release position, and in that the blocking lever (73), in the obstructing position, limits the movement area of the push element (72), at least indirectly, such that the push element (72) cannot be moved for the purpose of switching on the circuit breaker (48).

8. Apparatus according to claim 7, characterized in that the blocking lever (73) is loaded by a spring (74) in the direction of the obstructing position.

9. Apparatus according to claim 7, characterized in that the push element (72) has a projection that can be blocked by the blocking lever (73).

* * * * *